US006489941B1

(12) United States Patent
Inage et al.

(10) Patent No.: US 6,489,941 B1
(45) Date of Patent: Dec. 3, 2002

(54) LIQUID CRYSTAL DISPLAY APPARATUS WITH DRIVING CIRCUIT TO MAKE FULL USE OF TL-AFLC RESPONSE SPEED AND METHOD FOR DRIVING THE APPARATUS

(75) Inventors: Fumiaki Inage, Miyagi-ken (JP); Naoki Ito, Miyagi-ken (JP); Chen Guo Ping, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/525,572

(22) Filed: Mar. 15, 2000

(30) Foreign Application Priority Data

Mar. 18, 1999 (JP) ..... 11-074612

(51) Int. Cl.[7] ..... G09G 3/36
(52) U.S. Cl. ..... 345/98; 345/97; 345/100
(58) Field of Search ..... 345/93–95, 97, 345/98, 100

(56) References Cited

U.S. PATENT DOCUMENTS 5,490,000 A * 2/1996 Tanaka et al. ..... 349/171
5,642,128 A 6/1997 Inoue
5,812,191 A * 9/1998 Orava et al. ..... 250/370.09
6,046,790 A * 4/2000 Hara et al. ..... 349/172

* cited by examiner

*Primary Examiner*—Richard Hjerpe
*Assistant Examiner*—Duc Q Dinh
(74) *Attorney, Agent, or Firm*—Brinks Hofer Gilson & Lione

(57) ABSTRACT

A liquid crystal display apparatus with a driving circuit to make full use of an inherently high response speed of TL-AFLC. In addition to a source driver and a gate driver of conventional structures, the apparatus comprises a resetting source driver and a resetting gate driver for applying, upon writing of video signals to all pixels on a given scanning line in one horizontal period, a reset voltage for resetting beforehand any voltages remaining in all pixels on a plurality of scanning lines following that given scanning line. Application of the reset voltage takes place prior to the one horizontal period in which to write the video signals to all pixels on the scanning line in question and over a plurality of horizontal periods preceding that one horizontal period.

4 Claims, 7 Drawing Sheets

LIQUID CRYSTAL DISPLAY APPARATUS WITH DRIVING CIRCUIT TO MAKE FULL USE OF TL-AFLC RESPONSE SPEED AND METHOD FOR DRIVING THE APPARATUS

BACKGROUND OF THE INVENTION

1. Field of the Invention

The present invention relates to a liquid crystal display apparatus and a method for driving the apparatus. More particularly, the invention relates to a driving circuit adapted advantageously to a liquid crystal display apparatus utilizing anti-ferroelectric liquid crystal as its liquid crystal material, and a method for driving the LCD apparatus.

2. Description of the Related Art

Anti-ferroelectric liquid crystal (AFLC) is one of a variety of liquid crystal materials used by liquid crystal displays (LCD). An LCD apparatus that utilizes AFLC causes liquid crystal molecules to block or transmit light therethrough by driving the molecules between two phases: an anti-ferroelectric phase with no electric field turned on, and a ferroelectric phase with an electric field activated.

Threshold-less anti-ferroelectric liquid crystal (TL-AFLC) is particularly noted for its wide angles of visibility and its high response speed. A voltage-transmittance curve (V-T curve) of TL-AFLC has a symmetrical V-shaped characteristic around an origin, as shown in FIG. 7. In terms of response times, twisted nematic (TN) liquid crystal takes dozens of milliseconds to respond when driven, while TL-AFLC merely takes tens of microseconds to act. That means TL-AFLC is quicker to respond than TN liquid crystal by as many as three orders of magnitude.

Alternate driving is one of the commonly employed methods for driving LCD. The alternate driving method involves driving LCD by alternating, illustratively in increments of frames, the polarity of video signals (voltages) applied to the liquid crystal through the use of an AC voltage. Generally, one frame lasts about 16 milliseconds. Within that time frame, each scanning line is fed with a gate pulse whose width is about 16 microseconds needed to drive all scanning lines of the frame illustratively on an XGA display. The pulse width varies with the number of scanning lines used.

One disadvantage of the conventional alternate driving method above is that when applied to an LCD apparatus using TL-AFLC as its liquid crystal material, the method causes the LCD to lose its response speed resulting in a moving picture afterimage phenomenon. The reason is as follows: if the width of a gate pulse applied to each scanning line is illustratively 16 microseconds, that means the write time per scanning line is 16 microseconds as opposed to the response time of tens of microseconds of TL-AFLC. When the response time of TL-AFLC is longer than its write time, the writing of data within a single frame time fails to let TL-AFLC fully respond. Hence the inability to obtain an adequate transmittance.

To obtain the necessary transmittance requires writing data not in a single frame but across multiple frames. This translates into an effectively prolonged response time for the LCD as a whole. For example, the writing of data in five frames involves a response time of 16 milliseconds×5=80 milliseconds. That is, the response time of TL-AFLC ends up being equivalent to that of TN-LCD. In order to suppress moving picture afterimages, it is necessary ideally to complete the writing of data within a single frame time. With the conventional driving method, however, afterimages are unavoidable because the method requires carrying out data writes over a plurality of frames. Although TL-AFLC used in the LCD is supposed to offer a high response speed, the actual response speed of the liquid crystal material when driven is reduced to levels of other slow-to-respond liquid crystals. There has been a need for methods that would make full use of the inherently quick response of TL-AFLC used in LCD apparatuses.

SUMMARY OF THE INVENTION

The present invention has been made in view of the above circumstances and provides a liquid crystal display apparatus having a driving circuit to make full use of the inherently high response speed of TL-AFLC, and a method for driving the apparatus.

In carrying out the invention and according to a first aspect thereof, there is provided a liquid crystal display apparatus having a driving circuit comprising: a signal line driving means having anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels, the signal line driving means driving the plurality of signal lines; a scanning line driving means for driving the plurality of scanning lines; and a reset voltage applying means for use when video signals are written to all pixels on any one of the plurality of scanning lines in one horizontal period, the reset voltage applying means applying a reset voltage for resetting beforehand any voltages remaining in all pixels on a plurality of scanning lines which are contiguous to the one scanning line and to which the video signals are written following the one horizontal period, the applying of the reset voltage being performed prior to the one horizontal period in which to write the video signals to all pixels on the one scanning line and over a plurality of horizontal periods temporally continuous to the one horizontal period.

According to a second aspect of the invention, there is provided a liquid crystal display apparatus having a driving circuit comprising: a signal line driving means having anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels, the signal line driving means driving the plurality of signal lines; a scanning line driving means for driving the plurality of scanning lines; and a reset voltage applying means for use when video signals are written to all pixels on any one of the plurality of scanning lines in one horizontal period, the reset voltage applying means applying a reset voltage for resetting beforehand any voltages remaining in all pixels on a plurality of scanning lines which are separated from the one scanning line and to which the video signals are written following the one horizontal period, the applying of the reset voltage being performed prior to the one horizontal period in which to write the video signals to all pixels on the one scanning line and over a plurality of horizontal periods temporally separated from the one horizontal period.

There are liquid crystal display apparatuses that adopt what is known as a line sequential driving method whereby scanning lines are sequentially scanned from top to bottom while being fed with a signal one line at a time. For such LCD apparatuses, one frame time divided by the number of scanning lines gives a driving time per scanning line (for one horizontal (1H) period). That is, there is no spare time left in each frame time. On the other hand, writing a signal to the signal line driving means (source driver) leaves enough time to spare. A clock signal for the signal line driving means generally contains per horizontal period the pluses numbering greater than the number of signal lines. Upon completion of the writing of data corresponding to the actual number of signal lines, a short time (e.g., equivalent to about 10% of the total number of pulses in each horizontal period) is left out as a blanking period.

Taking account of such a spare time existing per horizontal period upon writing of a signal to the signal line driving means, the inventors of this invention came up with an idea: that any voltage remaining in the liquid crystal should be initially reset by taking advantage of the spare time, followed by a write operation (i.e. application of a voltage) in order to let the liquid crystal fully respond to the subsequently applied voltage. The term "reset" refers herein to a state where no voltage is being applied to the liquid crystal. In other words, the reset voltage is a zero voltage.

Because it also takes time for the liquid crystal to respond when its energized state is reset to a zero voltage state, the spare time within each horizontal period is not sufficient as a time in which to apply the reset voltage; a complete reset state is yet to be reached. This bottleneck is circumvented by the driving circuit of the liquid crystal display apparatus according to the first aspect of the invention as follows: when video signals are written to all pixels on any one of the plurality of scanning lines in one horizontal period, the driving circuit applies a reset voltage for resetting beforehand any voltages remaining in all pixels on a plurality of scanning lines which are contiguous to the one scanning line and to which the video signals are written following the one horizontal period. Application of the reset voltage takes place prior to the one horizontal period in which to write the video signals to all pixels on the one scanning line and over a plurality of horizontal periods temporally continuous to the one horizontal period. According to the second aspect of the invention, the driving circuit of the liquid crystal display apparatus applies a reset voltage for resetting beforehand any voltages remaining in all pixels on a plurality of scanning lines which are separated from the one scanning line and to which the video signals are written following the one horizontal period. Application of the reset voltage takes place prior to the one horizontal period in which to write the video signals to all pixels on the one scanning line and over a plurality of horizontal periods temporally separated from the one horizontal period.

In any case, although the reset voltage application time within each horizontal period is short, applying the reset voltage over a plurality of horizontal periods makes it possible to reach a complete reset state. After the complete reset state has been attained, the writing of data to each pixel starts from a zero voltage state in the positive or negative voltage direction, which shortens the response time of the liquid crystal. Referring to FIG. 7, inversion of the applied voltage from +V1 to −V1 by the conventional driving method entails a prolonged response time because the liquid crystal responds by tracing a V-shaped path indicated by arrows Y1 and Y2. The inventive scheme, by contrast, applies the voltage starting from 0 V following a reset. In this case, the liquid crystal need only trace half of the V-shaped path indicated by arrow Y2, which means the conventionally experienced response time is approximately halved.

When a reset voltage is applied to a plurality of scanning lines, the number of scanning lines to which to apply the reset voltage simultaneously is preferably an integer multiple of $\tau$ off/$\tau$ reset, where $\tau$ of f is the longest of graduated response speed fall times and $\tau$ reset is the time in which to apply the reset voltage. A maximum allowable number of scanning lines to which to apply the reset voltage simultaneously should be one which corresponds to a half frame. One disadvantage of a scanning line count exceeding the half frame is that users will have difficulty perceiving the continuity of pictures and find screens inordinately darkened.

In the liquid crystal display apparatus according to the second aspect of the invention, a sum of a reset time and a wait time is preferably half of one frame time at most, the reset time ranging from the time when the reset voltage applying means starts applying the reset voltage to all pixels on one scanning line, to the time when the applying of the reset voltage ends, the wait time ranging from the time when the applying of the reset voltage to all pixels on the one scanning line ends, to the time when the writing of the video signals starts. That is, when the reset voltage is applied to a plurality of scanning lines which are separated from the scanning line subject to a write operation, as in the second aspect of the invention, there is a rule of thumb for the separation whose extent must not be arbitrary. Since applying the reset voltage to scanning lines erases displays of all pixels thereon, if the sum of the reset time and the wait time exceeds half the frame time, users will have difficulty perceiving the continuity of pictures and find screens inordinately darkened.

According to a third aspect of the invention, there is provided a method for driving a liquid crystal display having anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels, the method comprising the steps of: when video signals are written to all pixels on any one of the plurality of scanning lines in one horizontal period, applying a reset voltage for resetting beforehand any voltages remaining in all pixels on a plurality of scanning lines to which the video signals are written following the one horizontal period, the applying of the reset voltage being performed over a plurality of horizontal periods prior to the one horizontal period; and applying, to all pixels on one scanning line fed with the reset voltage, a driving voltage at least 1.5 times a graduated voltage determined by the liquid crystal material in use in order to write the video signals.

As outlined above, the liquid crystal display apparatus according to the invention shortens the response time of the liquid crystal by use of the driving circuit. Still, the shortening of the response time can be insufficient depending on the type of liquid crystal or under various conditions specific to the LCD apparatus in question. That is, the writing of video signals may not be accomplished within a single frame. In such a case, the write voltage may be raised to reduce the response time. The response time reduction is made possible because the response time $\tau$ of liquid crystal is subject to the relation $$\tau\ 1/(Ps \cdot E) \tag{1}$$

where, Ps denotes spontaneous polarization of the liquid crystal and E denotes an applied electric field.

For a liquid crystal display apparatus, its V-T curve (voltage-transmittance characteristic curve) is used as a basis for establishing graduated voltages in keeping with a desired gradation count. Since the V-T curve varies from one liquid crystal material to another, the graduated voltages are determined specifically with respect to the liquid crystal material used by the LCD apparatus in question.

The relation (1) above may be modified as follows:

$$\tau\ d/(Ps \cdot V) \quad (2)$$

where, d represents a substrate-to-substrate gap (i.e., thickness of the liquid crystal layer) and V denotes the applied voltage. From the relation (2) above, it will be appreciated that the response time is also shortened by reducing the substrate-to-substrate gap.

Other objects, features and advantages of the invention will become more apparent upon a reading of the following description and appended drawings.

BRIEF DESCRIPTION OF THE DRAWINGS

Preferred embodiments of the present invention will be described in detail with reference to the following figures wherein.

DESCRIPTION OF THE PREFERRED EMBODIMENTS

First Embodiment

Figure 1:
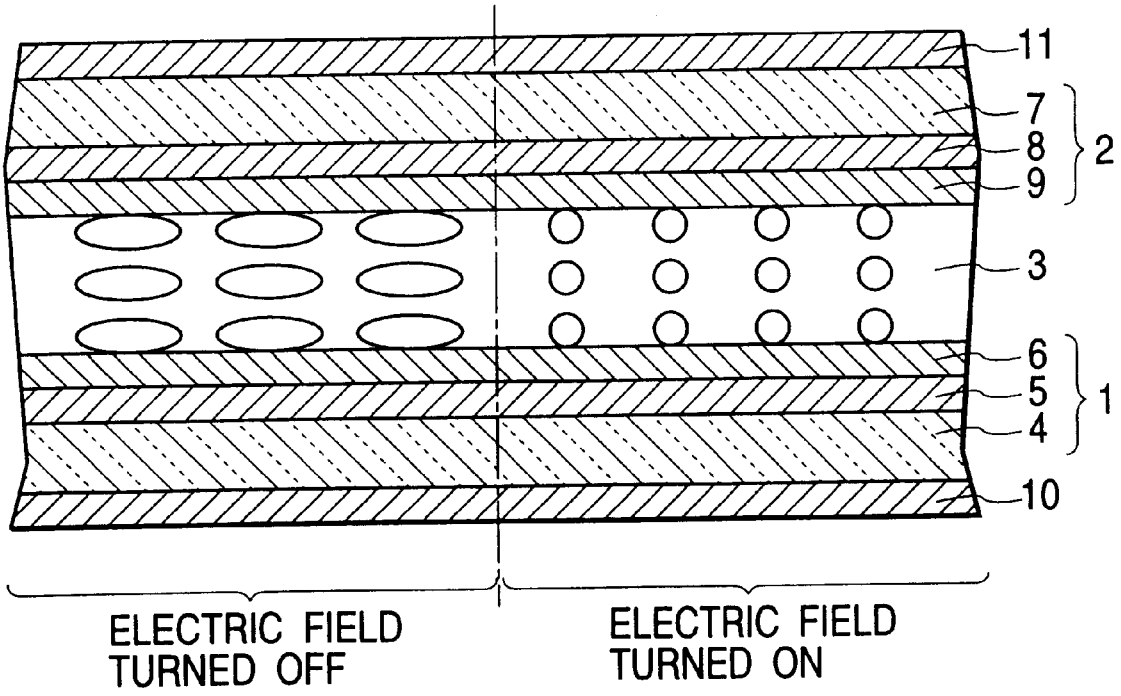
FIG. 1 is a cross-sectional view of a cell structure in a liquid crystal display apparatus practiced as a first embodiment of the invention.

The first embodiment of this invention will now be described with reference to FIGS. 1 through 4. FIG. 1 is a cross-sectional view of a cell structure in the liquid crystal display apparatus practiced as the first embodiment. As shown in FIG. 1, an active matrix substrate 1 having TFT arrays is faced with an opposed substrate 2. Threshold-less anti-ferroelectric liquid crystal (TL-AFLC) 3 is sandwiched between the two substrates 1 and 2. On the side of the active matrix substrate 1, transparent electrodes 5 and an oriented film 6 are stacked successively on a transparent substrate 4. Likewise, transparent electrodes 8 and an oriented film 9 are deposited one after another on a transparent substrate 7 on the side of the opposed substrate 2. The substrates 1 and 2 are furnished on their exterior with deflection plates 10 and 11 respectively. The first embodiment utilizes: six-inch-square soda glass substrates as the transparent substrates 4 and 7; ITO films as the transparent electrodes 5 and 8; RN1286 (product name, available from Nissan Chemical Industries, Ltd.) as the oriented films 6 and 9; AGK20 (product name, available from Sanritsu Co., Ltd.) as the deflection plates 10 and 11; and MX-X532 (product name, available from Mitsubishi Gas Chemical Co., Inc.) as the liquid crystal 3.

Figure 2:
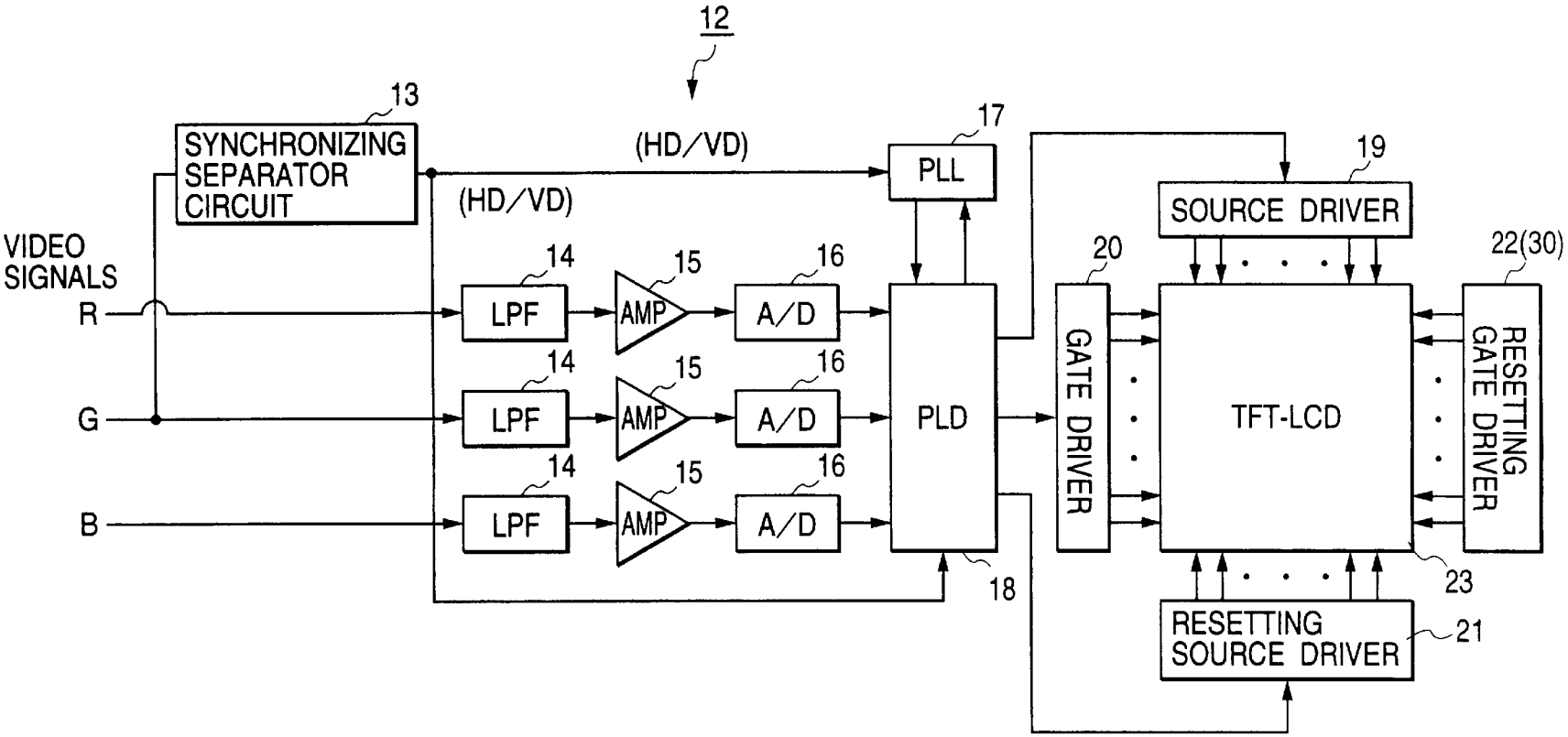
FIG. 2 is a block diagram showing an overall constitution of the first embodiment.

FIG. 2 is a block diagram showing an overall constitution of the liquid crystal display apparatus as the first embodiment including a driving circuit 12. In the driving circuit 12 of FIG. 2, a synchronizing separator circuit 13, a low-pass filter (LPF) 14, an amplifier circuit (AMP) 15, an A/D converter (A/D) 16, a phase-locked loop circuit (PLL) 17, a programmable logic device (PLD) 18, a source driver 19 (constituting the signal line driving means), and a gate driver 20 (constituting the scanning line driving means) are components of conventional structures. What characterizes this makeup is that the driving circuit 12 includes a resetting source driver 21 (constituting the reset voltage applying means) and a resetting gate driver 22 (also constituting the reset voltage applying means).

Figure 4:
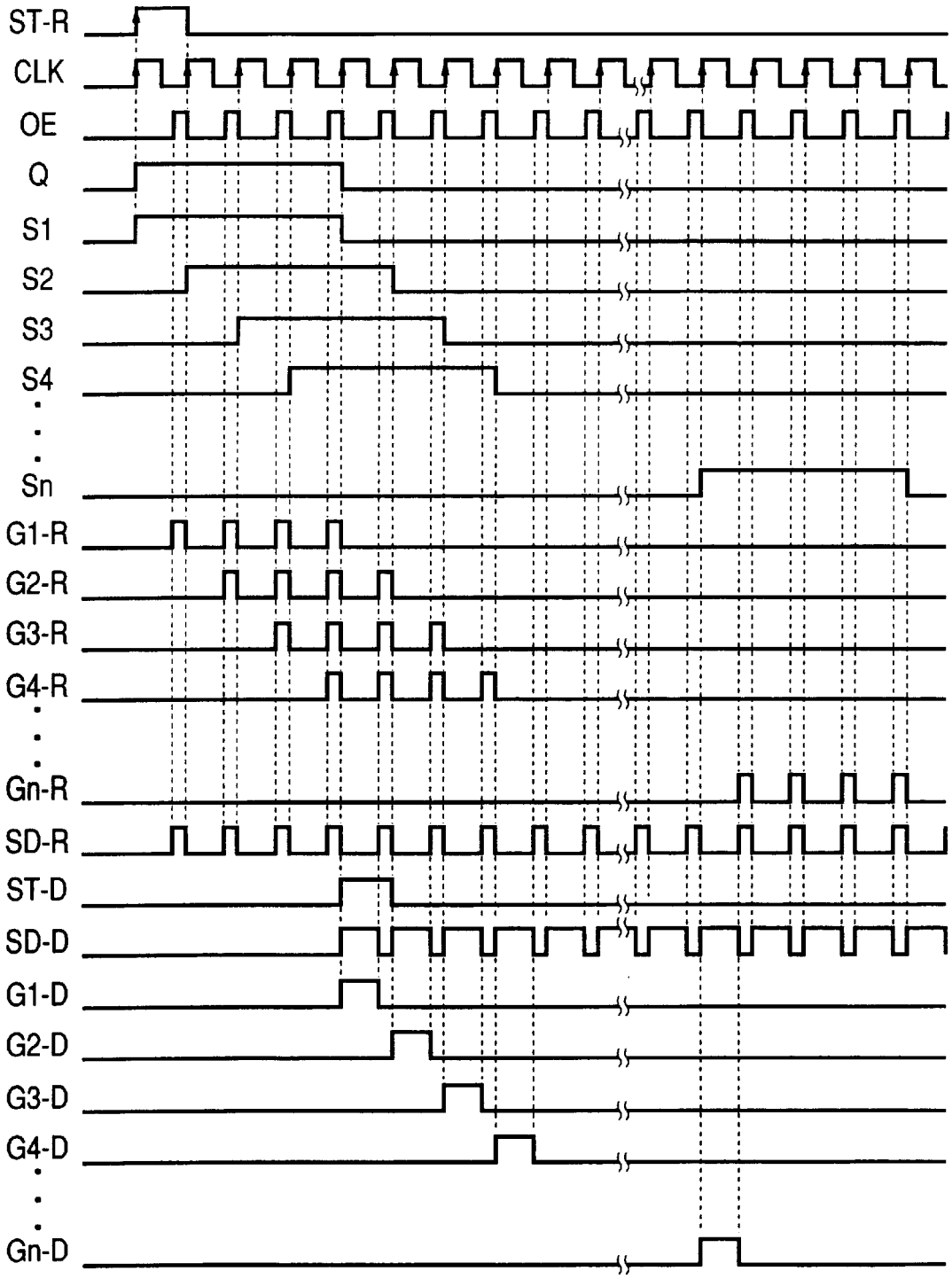
FIG. 4 is a timing chart for explaining how the first embodiment works.

Described below is an example in which the driving circuit 12 of the above constitution typically works. When writing video signals to all pixels on a given gate line (scanning line) of the screen, the first embodiment in this example applies a reset voltage to four gate lines contiguous to that given gate line over four horizontal periods that are temporally continuous to one horizontal period in which to write the video signals to the gate line in question. FIG. 4 is a timing chart of various signals used by the first embodiment.

(1) Video signals (R, G, B) pass through the synchronizing separator circuit 13 (G only), LPF 14 and AMP 15 to reach the A/D converter 16 for analog-to-digital conversion. The converted signals are subjected to necessary data computations by the PLD 18 before being fed to the source driver 19.

(2) The PLL 17 generates a reference clock (CLK) based on a vertical synchronizing signal (VD) and a horizontal synchronizing signal (HD), both output by the synchronizing separator circuit 13. The reference clock thus generated is input to the PLD 18. In turn, the PLD 18 generates various timing signals on the basis of the reference clock. In particular, the PLD 18 internally generates a driving signal (SD-R) for driving the resetting source driver 21 and outputs the signal to the driver 21 in synchronism with "ON" pulses of an internally generated output enable signal (OE). The OE signal is turned on over a short period after completion of a data write following the output of a start pulse signal (ST-R) within each horizontal period (1H).

(3) Upon receipt of the driving signal SD-R, the resetting source driver 21 outputs "0" data to all source lines. At the same time, the resetting gate driver 22 outputs a resetting pulse signal (G1-R) to a first gate line.

(4) The resetting gate driver 22 outputs G1-R and G2-R (a resetting pulse signal directed to a second gate line) to the respective gate lines. The driver 22 then outputs G1-R, G2-R and G3-R (a resetting pulse signal directed to a third gate line) to the respective gate lines, followed by G1-R, G2-R, G3-R and G4-R (a resetting pulse signal directed to a fourth gate line) output to the respective gate lines. At this point, the first through the fourth gate lines are considered to be reset concurrently. As in the step (2) above, the resetting source driver 21 outputs "0" data to all source lines simultaneously.

Figure 3:
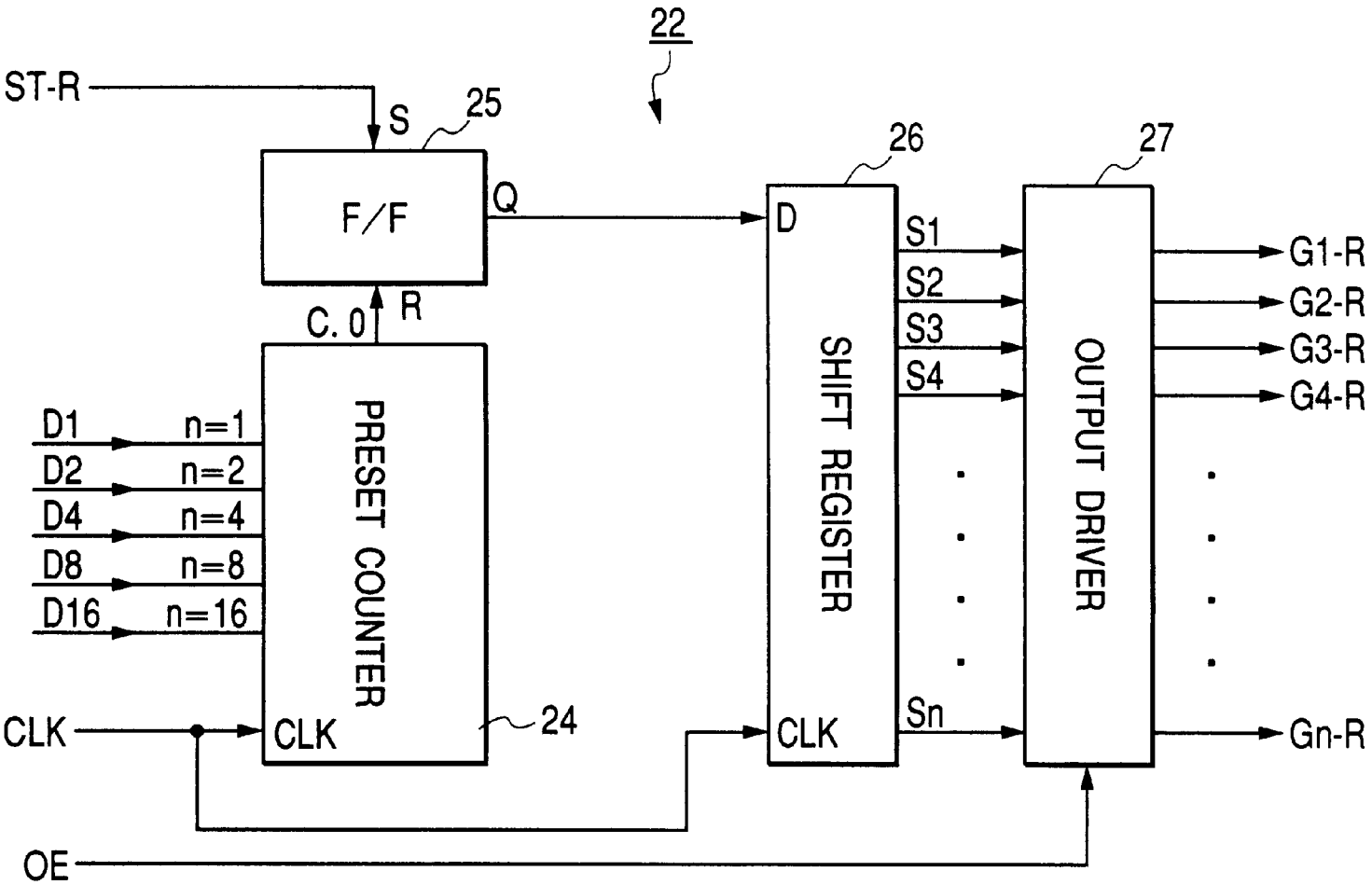
FIG. 3 is a block diagram of a resetting gate driver used by the first embodiment.

FIG. 3 is a block diagram depicting an internal circuit constitution of the resetting gate driver 22. More detailed workings of the resetting gate driver 22 are described below with reference to FIG. 3.

(4-1) A preset counter 24 is used to establish a preset count n (i.e., number of gate lines to be reset concurrently). In this example, D4 (n=4) is selected.

(4-2) A signal Q is generated by a flip-flop (F/F) 25 based on that output (C.O) of the preset counter 24 which is input to a terminal R of the F/F 25. The signal Q thus generated is output to a shift register 26 in synchronism with an "ON" state of the start pulse signal (ST-R) input to a terminal S of the F/F 25.

(4-3) The shift register 26 generates signals S1, S2, S3, . . . , Sn one pulse apart on the "n=4" pulse clock, and outputs the generated signals to an output driver 27.

(4-4) With the signals S1, S2, S3, . . . , Sn driven High, the output driver 27 generates reset signals G1-R, G2-R, G3-R, . . . , Gn-R whose pulses are raised only during the High period of the separately input OE pulse signal. The reset signals thus generated are output successively to the gate lines. This turns on the TFTs of all pixels on each gate line, writing the resetting data "0" to the pixels. Executing these steps brings about the reset state.

(5) On the first gate line, the reset operation ends in the step (4) above, followed by a data write operation. If the reset count is four (n=4), a write data start pulse signal ST-D generated by the PLD 18 goes High at this point. The signal ST-D is output to the source driver 19 and gate driver 20.

(6) On receiving the start pulse signal ST-D, the source driver 19 generates a video signal (SD-D) whose pulse rises at a trailing edge of the OE signal and falls at a leading edge of the same OE signal. The video signal SD-D thus generated is output to all source lines.

(7) Upon receipt of the start pulse signal ST-D, the gate driver 20 generates a driving signal (G1-D) whose pulse rises at a trailing edge of the OE signal and falls at a leading edge of the same OE signal. The driving signal G1-D thus generated is output to the first gate line.

(8) The resetting source driver 21 is turned on, and the next gate line below is reached which will receive the signals G1-R through Gn-R to be output by the resetting gate driver 22. The resetting gate driver 22 then outputs the reset signal to the gate line. Specifically, the second through the fifth gate lines to which G2-R, G3-R, G4-R and G5-R are output are reset simultaneously in the next step.

(9) On receiving the start pulse signal ST-D, the source driver 19 outputs the video signal SD-D to all source lines. Meanwhile, the next gate line below is reached which will receive a driving signal to be output by the gate driver 20. A driving signal G2-D is output to the second gate line.

(10) The steps (8) and (9) above are repeated until the gate driver 20 outputs the driving signal Gn-D to the n-th gate line to end the write operations to all pixels on all gate lines. This completes one frame. It should be noted that by the time the write operation to the pixels on the n-th gate line is complete, the pixels on the first through the fourth gate lines have been reset.

For the first embodiment, the voltage applied to the liquid crystal TL-AFLC 3 is designed to range from 0 V to 6 V, i.e., 1.5 times the graduated voltage determined by the liquid crystal material in use. The voltage application time (write time) per gate line is set for 16 microseconds, and the gap between the oriented films 6 and 9 is reduced from the conventional 2 micrometers to 1.5 micrometers.

When writing data to a given gate line on the screen, the liquid crystal display apparatus as the first embodiment resets all pixels on the gate line in question by writing zeros to them over four horizontal periods prior to the horizontal period in which to write data to the gate line in question. This arrangement permits sufficient overall resetting even though the reset time per horizontal period is very short. That in turn causes the response time of the liquid crystal to be shortened considerably. Because the voltage applied to the liquid crystal material is made 1.5 times the graduated voltage determined by the liquid crystal material in use and because the cell gap is narrowed, the response time of the liquid crystal is reduced to 10 through 20 microseconds. The response time thus obtained is close to the inherent response time of TL-AFLC. As a result, the inventive liquid crystal display apparatus provides a quick-to-respond screen display free of afterimages, heretofore unavailable.

Second Embodiment

The second embodiment of this invention will now be described with reference to FIGS. 2, 5 and 6. The first embodiment was shown resetting a plurality of gate lines contiguous to a given gate line over a plurality of horizontal periods temporally continuous to one horizontal period in which to write data to the gate line in question. The second embodiment, by contrast, will be shown resetting a plurality of gate lines separated from a given gate line over a plurality of horizontal period temporally separated from one horizontal period in which to write data to the gate line in question. The overall constitution of the liquid crystal display apparatus practiced as the second embodiment is the same as that of the first embodiment (shown in FIG. 2) and thus will not be described further. What characterizes the second embodiment is a resetting gate driver that differs from that of the first embodiment in terms of constitution and workings. Below is a description of how the different resetting gate driver works and how it is structured.

Figure 5:
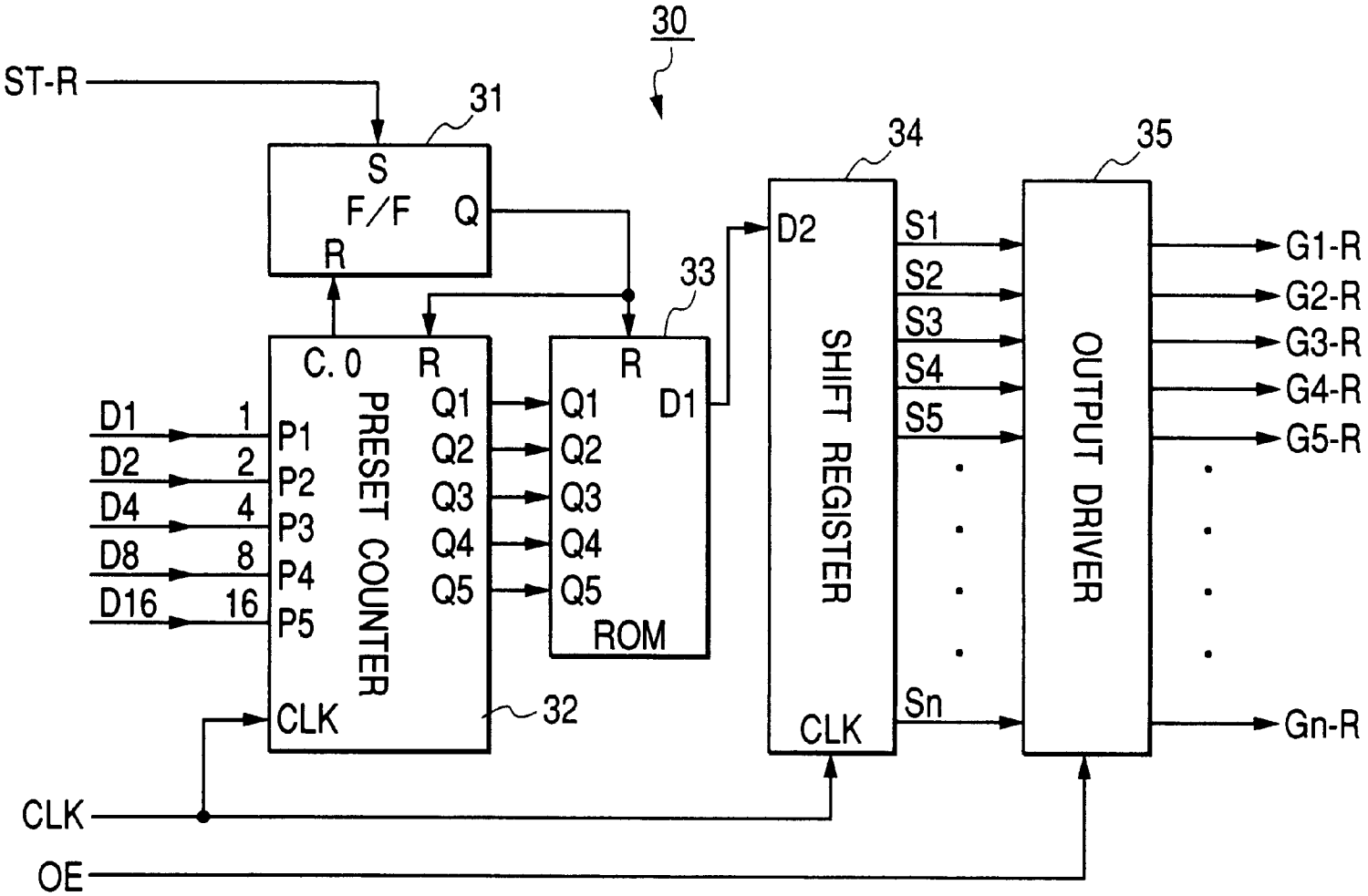
FIG. 5 is a block diagram of a resetting gate driver used by a liquid crystal display apparatus practiced as a second embodiment of the invention.
Figure 6:
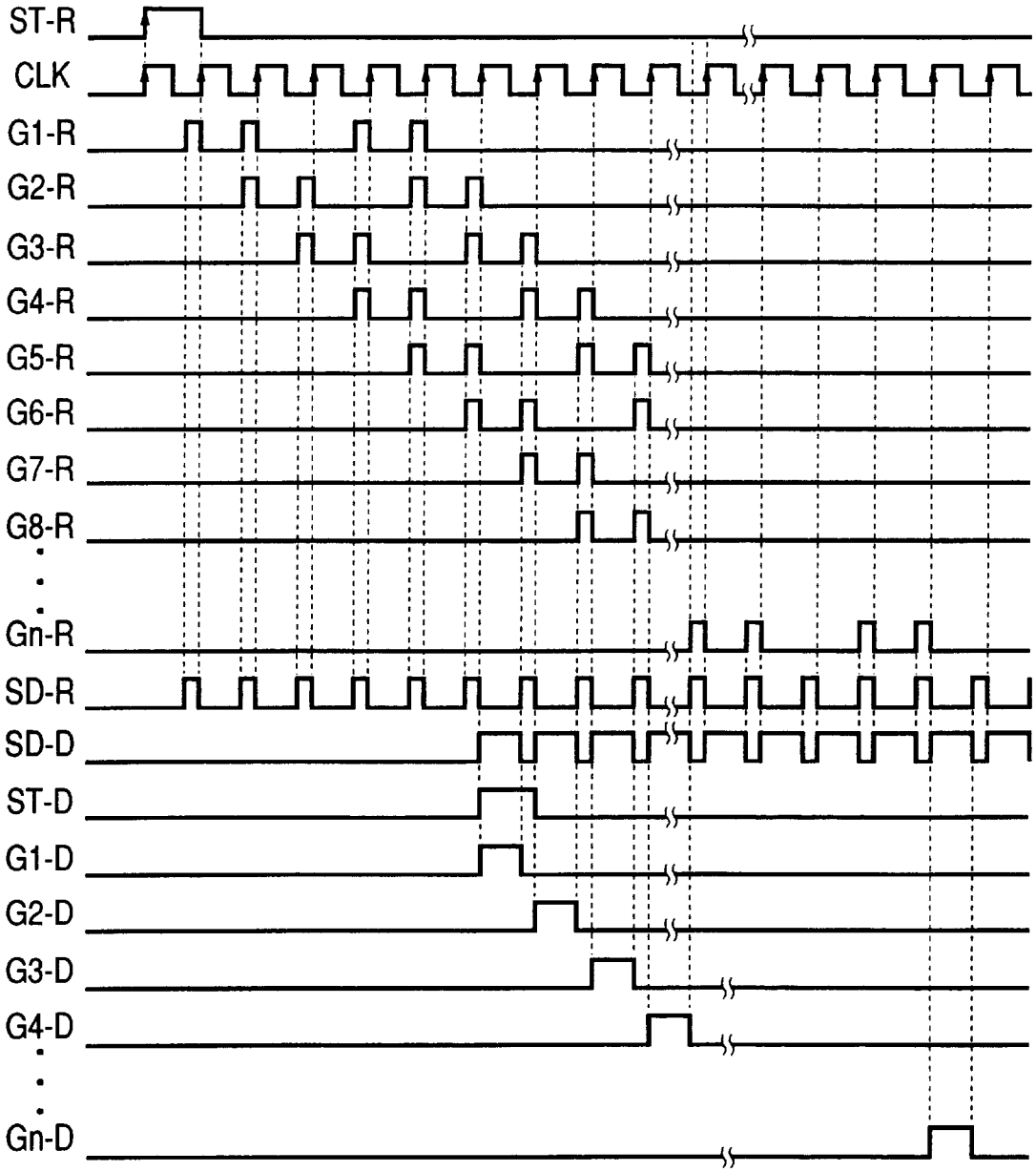
FIG. 6 is a timing chart for explaining how the second embodiment works.
Figure 7:
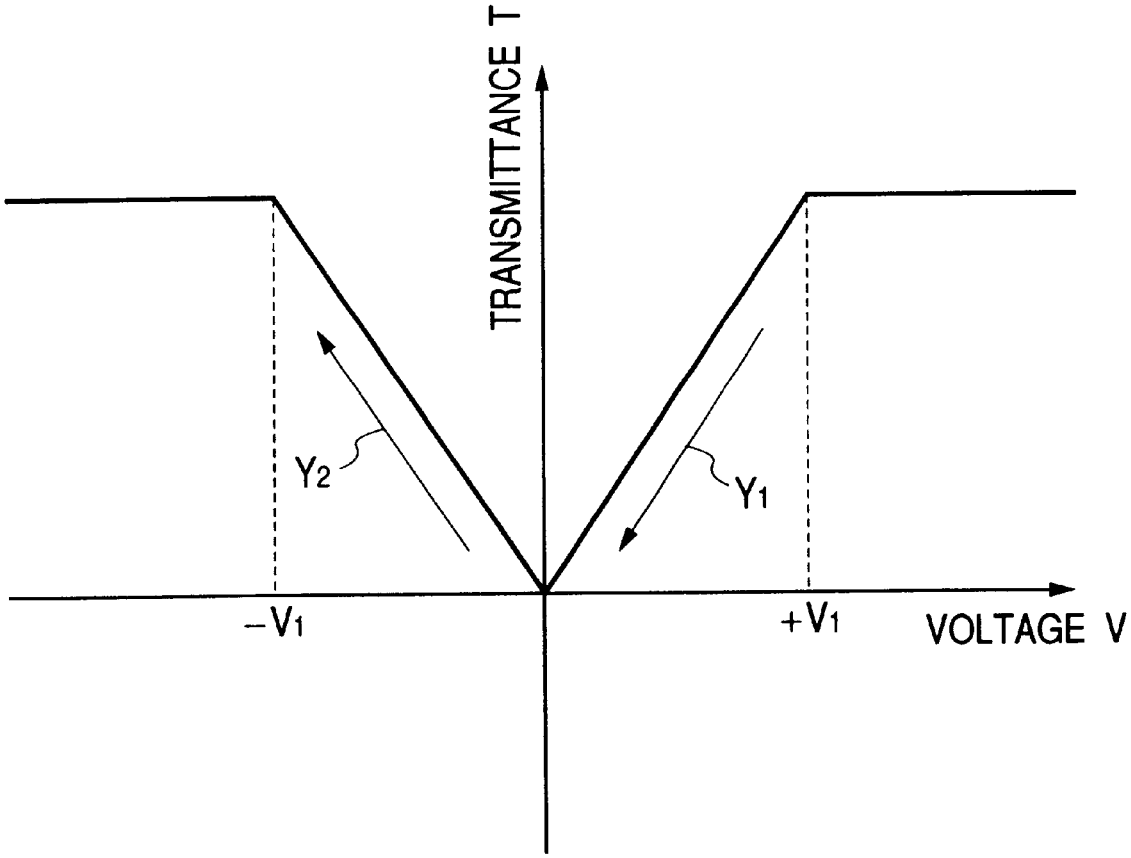
FIG. 7 PRIOR ART
FIG. 7 is a graphic representation of a voltage transmittance characteristic curve of TL-AFLC.

FIG. 5 is a block diagram of a resetting gate driver 30 used by the second embodiment, and FIG. 6 is a timing chart of various signals utilized by the second embodiment. Upon writing video signals to all pixels on a given gate line (scanning line) of the screen, the second embodiment in an example below first applies a reset voltage in two horizontal periods that are six periods earlier than a horizontal period in which to write the video signals to the gate line in question, applies another reset voltage one horizontal period later over two more horizontal periods, and then writes the data one horizontal period later.

(1) Video signals (R, G, B) pass through the synchronizing separator circuit 13 (G only), LPF 14 and AMP 15 to reach the A/D converter 16 for analog-to-digital conversion. The converted signals are subjected to necessary data computations by the PLD 18 before being fed to the source driver 19.

(2) The PLL 17 generates a reference clock (CLK) based on a vertical synchronizing signal (VD) and a horizontal synchronizing signal (HD), both output by the synchronizing separator circuit 13. The reference clock thus generated is input to the PLD 18. In turn, the PLD 18 generates various timing signals on the basis of the reference clock. In particular, the PLD 18 internally generates a driving signal (SD-R) for driving the resetting source driver 21 and outputs the signal to the driver 21 in synchronism with "ON" pulses of an internally generated output enable signal (OE).

(3) Upon receipt of the driving signal SD-R, the resetting source driver 21 outputs "0" data to all source lines. At the same time, the resetting gate driver 30 outputs a resetting pulse signal (G1-R) to a first gate line.

(4) The resetting gate driver 30 outputs G1-R and G2-R to the gate lines, followed by G1-R, G2-R and G3-R output to the gate lines. The driver 30 then outputs G1-R, G2-R, G3-R and G4-R to the gate lines, followed by 1-R, G2-R, G3-R, G4-R and G5-R output to the gate lines. At this point, the first, the second, the fourth and the fifth gate lines are considered to be reset concurrently. As in the step (2) above, the resetting source driver 21 outputs "0" data to all source lines simultaneously.

More detailed workings of the resetting gate driver 30 are described below with reference to FIG. 5.

(4-1) The start pulse signal ST-R is used to set the F/F 31. An output Q of the F/F 31 is used to release the reset state of a preset counter 32 and a ROM 33 (reset sequence storing ROM), and a reset operation of the resetting gate driver 30 is started.

(4-2) A reset sequence is stored into the ROM 33 (in this example, the sequence is one in which resets are executed successively over two horizontal periods followed by a no-reset state of one horizontal period, and more resets are performed consecutively over two horizontal periods). Specifically, a reset state is represented by 1 and a no-reset state by 0 so that the reset sequence may be stored illustratively as "1," "1," "0,1" "1" and "1."

(4-3) An output Qn of the preset counter 32 triggers output of data "11011" from an output terminal D1 of the ROM 33. The output data are input to an input terminal D2 of a shift register 34.

(4-4) The preset counter 32 is used to establish a preset count n. In this example, "n=5" is established (number of lines to be reset (4)+number of lines not to be reset (1)). The count is determined by getting the C.O output to reset the F/F 31.

(4-5) The shift register 34 generates signals S1, S2, S3, . . . , Sn one pulse apart on the "n=5" pulse clock, and outputs the generated signals to an output driver 35 (not shown in the timing chart of FIG. 6).

(4-6) With the signals S1, S2, S3, . . . , Sn driven High, the output driver 35 generates reset signals G1-R, G2- R, G3-R, . . . , Gn-R whose pulses are raised only during the High period of the separately input OE pulse signal. The reset signals thus generated are output successively to the gate lines. This turns on the TFTs of all pixels on each gate line, writing the resetting data "0" to the pixels.

(5) On the first gate line, the reset operation ends in the step (4) above followed by the reset state being maintained in the next single horizontal period, which in turn is followed by a data write operation in the ensuing horizontal period. At this point, a write data start pulse signal ST-D generated by the PLD 18 goes High. The signal ST-D is output to the source driver 19 and gate driver 20.

(6) On receiving the start pulse signal ST-D, the source driver 19 generates a video signal (SD-D) whose pulse rises at a trailing edge of the OE signal and falls at a leading edge of the same OE signal. The video signal SD-D thus generated is output to all source lines.

(7) Upon receipt of the start pulse signal ST-D, the gate driver 20 generates a driving signal (G1-D) whose pulse rises at a trailing edge of the OE signal and falls at a leading edge of the same OE signal. The driving signal G1-D thus generated is output to the first gate line. Meanwhile, during this horizontal period, the pulses of G3-R, G4-R, G6-R and G7-R are being raised. That means the reset voltage has been applied to the third, the fourth, the sixth and the seventh gate lines. In other words, when data are written to all pixels on the first gate line, all pixels on the third, the fourth, the sixth and the seventh gate lines separated from that gate line have been reset.

(8) The resetting source driver 21 is turned on, and the gate line below is reached which will receive the signals G1-R through Gn-R to be output by the resetting gate driver 30. The resetting gate driver 30 then outputs the reset signal to the gate line.

(9) On receiving the start pulse signal ST-D, the source driver 19 out puts the video signal SD-D to all source lines. Meanwhile, the next gate line below is reached which will receive a driving signal to be output by the gate driver 20. A driving signal G2-D is output to the second gate line.

(10) The steps (8) and (9) above are repeated until the gate driver 20 outputs the driving signal Gn-D to the n-th gate line to end the write operations to all pixels on all gate lines. This completes one frame.

When writing data to a given gate line on the screen, the liquid crystal display apparatus as the second embodiment also executes reset operations over four horizontal periods prior to the horizontal period in which to write data to the gate line in question. This arrangement permits sufficient overall resetting and thereby shortens the response time of the liquid crystal considerably. Unlike the first embodiment, the second embodiment is not subject to the four temporally continuous horizontal periods in which to perform resets. Instead, the second embodiment first executes resets in two horizontal period followed by a hold state of one horizontal period, and performs resets in another two horizontal periods followed by another hold state of one horizontal period, which in turn is followed by a data write operation. Nevertheless, because only a single horizontal period makes up the wait period ranging from the time when application of the reset voltage ends to the time when writing of video signals starts, users have no difficulty perceiving the continuity of pictures and will not find screens inordinately darkened.

Although the description above contains many specificities, these should not be construed as limiting the scope of the invention but as merely providing illustrations of some of the presently preferred embodiments of this invention. It is to be understood that changes and variations may be made without departing from the spirit or scope of the claims that follow. For example, it is obviously possible to modify as needed the number of gates to which to apply the reset voltage, the time during which to apply the voltage, the write voltage, and the specific constitution of the liquid crystal display apparatus.

As described, upon writing data to a given gate line on the screen, the liquid crystal display apparatus according to the invention executes reset operations over a plurality of horizontal periods prior to the horizontal period in which to write data to the gate line in question. This scheme shortens the response time of the liquid crystal considerably. Because an inherently high response speed of liquid crystal materials such as TL-AFLC is fully taken advantage of, it is possible to implement a liquid crystal display apparatus that provides a quick-to-respond screen display free of afterimages, heretofore unavailable.

What is claimed is:

1. A liquid crystal display apparatus having a driving circuit comprising:

an anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels;

signal line driving means driving the plurality of signal lines;

scanning line driving means for driving the plurality of scanning lines;

reset voltage applying means for applying a reset voltage to the scanning lines such that: prior to video signals being written to all pixels on any one of the plurality of scanning lines in one horizontal period and over a plurality of horizontal periods continuous to the one horizontal period, the reset voltage applying means applies the reset voltage to the same number of scanning lines adjacent to the one scanning line as that of the plurality of horizontal periods continuous to the one horizontal period, the reset voltage being applied to the adjacent scanning lines to be written subsequent to the one horizontal period and in a blanking period present in each of the plurality of horizontal periods; and reset voltage applying means for the signal lines for outputting data of "0" to all the signal lines for each of the blanking periods.

2. A liquid crystal display apparatus having a driving circuit comprising:

signal line driving means having anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels, the signal line driving means driving the plurality of signal lines;

scanning line driving means for driving the plurality of scanning lines; and reset voltage applying means for applying a reset voltage to the scanning lines such that: prior to video signals being written to all pixels on any one of the plurality of scanning lines in one horizontal period and over a plurality of horizontal periods separated from the one horizontal period, the reset voltage applying means applies the reset voltage to the same number of scanning lines as that of the plurality of horizontal periods separated from the one horizontal period, the reset voltage being applied to the scanning lines to be written subsequent to the one horizontal period in the same arrangement as the separation of the plurality of horizontal periods from the one horizontal period and in a blanking period present in each of the plurality of horizontal periods; and reset voltage applying means for the signal lines for outputting data of "0" to all the signal lines for each of the blanking periods.

3. A liquid crystal display apparatus according to claim 2, wherein a sum of a reset time and a wait time is at most half of one frame time, the reset time ranging from the time when the reset voltage applying means starts applying the reset voltage to all pixels on one scanning line, to the time when the applying of the reset voltage ends, the wait time ranging from the time when the applying of the reset voltage to all pixels on the one scanning line ends, to the time when the writing of the video signals starts.

4. A method for driving a liquid crystal display having an anti-ferroelectric liquid crystal sandwiched between an active matrix substrate and an opposed substrate, the active matrix substrate having a plurality of signal lines and a plurality of scanning lines arrayed in a matrix fashion to constitute a plurality of pixels, the method comprising the steps of:

when video signals are written to all pixels on any one of the plurality of scanning lines in one horizontal period, applying a reset voltage for resetting beforehand any voltages remaining in all pixels on the same number of scanning lines as that of a plurality of horizontal periods to which the video signals are written following the one horizontal period and in a blanking period present in each of the plurality of horizontal periods, the applying of the reset voltage being performed over the plurality of horizontal periods prior to the one horizontal period;

for outputting data of "0" to all the signal lines in the blanking period present in each of the plurality of horizontal periods; and applying, to all pixels on one scanning line fed with the reset voltage, a driving voltage at least 1.5 times a graduated voltage determined by the liquid crystal material in use in order to write the video signals.

* * * * *